United States Patent [19]

Wilson

[11] 4,353,180

[45] Oct. 12, 1982

[54] FIT ADJUSTABLE TELESCOPE MOUNT FOR FIREARMS

[76] Inventor: Hugh R. Wilson, 10840 SW. 120th St., Miami, Fla. 33176

[21] Appl. No.: 138,145

[22] Filed: Apr. 7, 1980

[51] Int. Cl.[3] ..... F41G 1/38

[52] U.S. Cl. ..... 42/1 ST; 33/250

[58] Field of Search ..... 42/1 ST; 33/250

[56] References Cited

U.S. PATENT DOCUMENTS 3,276,127 10/1966 Abrahamson ..... 42/1 ST
3,579,840 5/1969 Heinzel ..... 42/1 ST
3,877,166 4/1975 Ward ..... 42/1 ST
3,880,389 4/1975 Burris ..... 42/1 ST
4,205,473 6/1980 Wilson ..... 42/1 ST

*Primary Examiner*—Charles T. Jordan

[57] ABSTRACT

The invention is a telescope mount for firearms that is provided with a deflectable wing. The wing may be adjusted into a tighter mating contact with a base member to compensate for variations in manufacturing tolerances and also to compensate for wear that may occur in ordinary use. The deflectable wing may be tensioned as a spring or may be adjusted by wedges or by wedging screws until the desired fit is attained.

11 Claims, 7 Drawing Figures

FIT ADJUSTABLE TELESCOPE MOUNT FOR FIREARMS

FIELD OF THE INVENTION

The device is intended for use with firearms for hunting, target shooting and related sports, but also may be used for military and police purposes.

DESCRIPTION OF THE PRIOR ART

Although the use of a ring and the locking lug and base method shown in the drawings have been in use for many years, several serious problems have constantly confronted the user of telescope mounts of such construction. The most serious and most common problem is that of excessive tightness in the fit of the ring member on the base member. Since the lug on the underside of the ring member must be inserted into the base and rotated, excessive tightness will require excessive force to rotate the ring member. Since the telescope body is held by the ring member, the telescope is frequently used as a lever to force the ring into proper rotation with the result that the body of the telescope is severely damaged by bending. If the fit is too loose, the telescope and ring may move so as to adversely affect the accuracy of the firearm. A firm but moveable fit is essential for optimum results and the ability to adjust the fit of the ring member to the base member is provided by the simple and novel improvement invention as claimed herein.

SUMMARY OF THE INVENTION

It is an object of this invention to provide a new and novel means to adjust the fitting of a ring member to a base member so as to obtain optimum performance and accuracy.

It is another object of this invention to provide a method to avoid the bending and damageing of the telescope body.

It is a further object of this invention to avoid excessive tightness in the fit of a ring member to a base member so that the telescope may be returned to the same position if detached and re-attached to the firearm.

It is also an object of this invention to provide a means to compensate for variation in manufacturing tolerances and to compensate for wear.

A BRIEF DESCRIPTION OF THE DRAWINGS

DESCRIPTION OF THE PREFERRED EMBODIMENT

Figure 1:
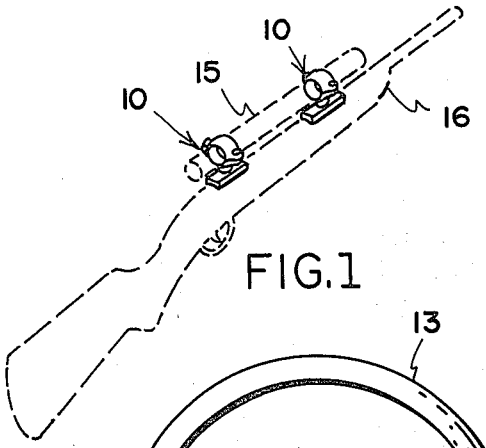
FIG. 1 shows a telescope mounted on a firearm.
Figure 2:
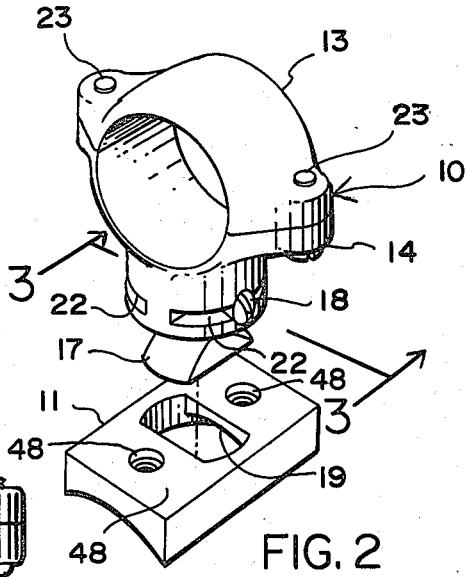
FIG. 2 is an exploded view showing the invention and a base.
Figure 3:
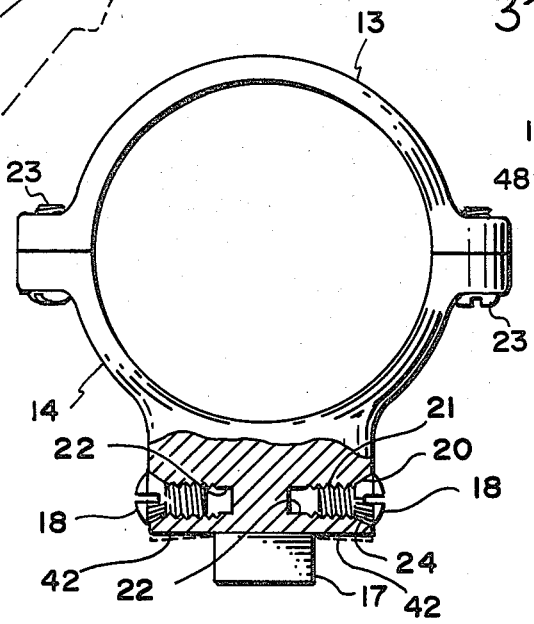
FIG. 3 is a cross sectional view showing the slots and screws.
Figure 4:
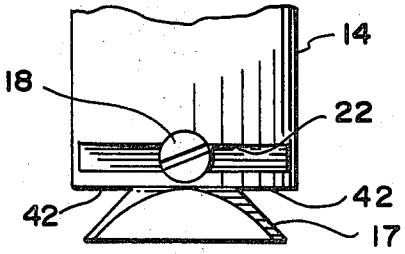
FIG. 4 is a side view.

Referring to the drawings by characters of reference, FIGS. 1–7 illustrate a fit-adjustable telescope mount for firearms.

The body 10 is constructed in two parts comprising the lower part 14 and the upper clamp 13. The two parts

14 and 13 when drawn together by the two screws 23 will hold a telescope for mounting on a firearm as shown in FIG. 1. This mount may be used as a front mount only or may be used as a front mount and also as a rear mount as shown mounted on the rifle 16 in FIG. 1.

The lower body portion 14 is provided with the lug 17 which when inserted into the cavity 19 of the base 11 and rotated to a locking position will secure the body 10 to the base 11.

The body portion 14 is provided with the slot 22 which forms a deflectable portion or wing which is deflectable downward into a tighter contact with the base 11. The deflectable portion 42 may deflect downward toward the base 11 or may deflect upwards away from the base 11. The deflection of the wing 42 is accomplished by the adjusting screw 18 which when turned into the threads 21 will cause the tapered portion 24 of the screw 18 to force the wing 42 downward into tighter contact with the surface 43 of the base 11. The degree of adjustment given to the screw 18 will determine the fit of the body portion 14 with the base 11 as the lug 17 is drawn against the underside of the cavity 19 of the base 11. The base 11 is fastened to a firearm by screws through the holes 48. Although the drawings show the slot 22 on both sides of the body portion 14, it is apparent that a slot on only one side could effect some adjustment.

Figure 5:
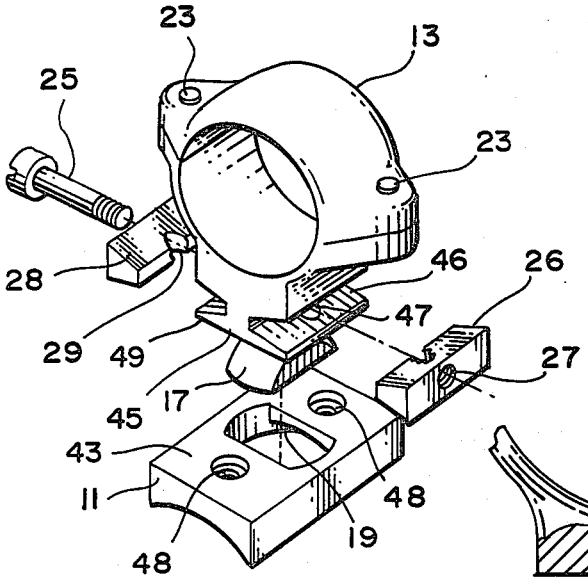
FIG. 5 is an exploded view showing the use of two wedges.

FIG. 5 illustrates a variation in which the lower portion 45 is provided with two slots 46 and two wedges 26 and 28 which are drawn into the slots 46 by tightening of the bolt 25 into the threaded hole 27 in the wedge 26 to deflect the wing 49 into contact with the surface 43 of the base 11.

Figure 6:
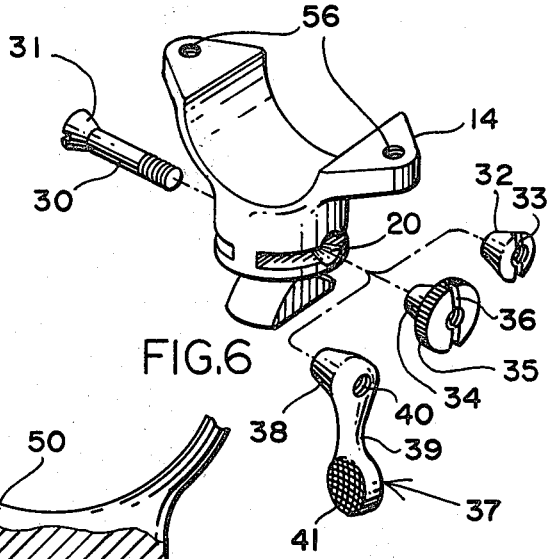
FIG. 6 shows the invention with alternate types of wedges.

FIG. 6 illustrates a variation in which the screw 30 extends through the body portion 14 and is engaged by the tapered nut 32 or alternatively, the thumb nut 34 or the lever nut 37. In the use of each, a tapered portion as 38 on the lever 37 acts on the tapered hole 20 to deflect the wing 42 into contact with the base 11 as described before. Although the method shown in FIG. 5 uses a bolt extending through the wedge 28 in the hole 29 and through the body portion 45 and into the threaded hole 27 of the wedge 26 to provide wedging, the variation shown in FIG. 6 uses the screw 30 with the tapered head 31 acting in the tapered hole 20 and the tapered nuts 32,34,37 act also on the tapered hole 20 to deflect the wing 42. The screw 30 extends through the body portion 14. The holes 56 are for attaching the upper clamp portion 13 to the lower portion 14.

Figure 7:
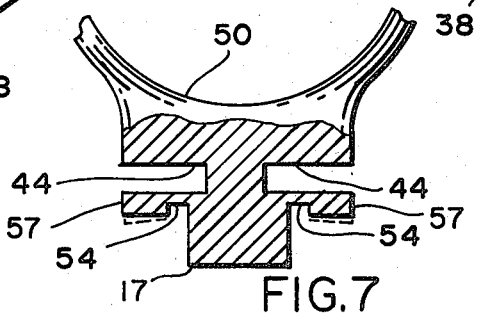
FIG. 7 shows the invention without the use of wedges.

FIG. 7 illustrates an additional variation in which no wedges are used. In this variation, the deflectable portion or wing 57 is of spring temperable material. The slots 44 form the wing 57 with the undercut 54 making the wing 57 more easily deflectable when the lug 17 draws the deflectable wings 57 into tight contact with the surface 43 of the base 11. (See FIGS. 2 and 5).

OPERATION OF THE DEVICE

To use the adjustable tensioning feature of the invention, the lug 17 is inserted into the cavity 19 of the base 11 and the entire scope ring 10 is rotated 90 degrees so that a telescope held by the ring is aligned with the bore of a rifle. If the fit is too loose or too tight, an adjustment may be made. With the variation shown in FIG. 7, the wings 57 may be slightly bent until the desired tension is obtained. With the device shown in FIGS. 2,3,4, the two screws 18 are turned inward or outward until the desired tensioning is obtained. With the variation shown in FIG. 5, the bolt 25 is turned inward or outward which draws the two wedges 26 and 28 inwardly to obtain the desired tension of the wings 49 against the face 43 of the base 11. With the variation shown in FIG. 6, the desired tension may be obtained by tightening the nut 32 on the bolt 30 using a screw driver in the slot 33 or by tightening the thumbnut 34 or the levernut 37. When using the levernut 37, the arm 39 is gripped by the checkered surface 41 and turned to the desired position. The tapered cone 38 is forced into the tapered hole 20 deflecting the wing 42 to the desired tension. The tapered cones on the nuts 32 and 34 perform the same function.

Although but a few embodiments of the invention have been shown and described, it will be apparent to those skilled in the art that various changes and modifications may be made therein without departing from the spirit of the invention or from the scope of the appended claims.

I claim:

1. A telescope mount for firearms comprising:

holding means for holding a telescope, lug means mounted on said holding means for attachment to a base, base means for attachment to a firearm, said base means having a cavity therein for receiving said lug means, said lug means being adaptable for vertical insertion into said cavity and being rotatable to a locked position within said cavity to hold said holding means and said base means closely together in a mated relationship, movable tensioning means comprising a deflectable wing mounted on said holding means for varying the degree of tightness between said holding means and said base means, said movable tensioning means being movable toward and away from said base means.

2. The structure as recited in claim 1 wherein said tensioning means is a deflectable wing formed on said holding means.

3. The structure as recited by claim 2 to include wedging means for deflecting said tensioning means into tighter contact with said base means.

4. The structure as recited by claim 3 to include lever means for providing leverage to said wedging means.

5. The structure as recited by claim 2 wherein said deflectable wing is undercut to facilitate deflection.

6. In a telescope mount having holding means for holding a telescope, lug means mounted on said holding means for attachment to a base, base means for attachment to a firearm, said base means having a cavity therein for receiving said lug means, said lug means being adaptable for vertical insertion into said cavity and being rotatable therein to a locked position within said cavity to hold said holding means and said base means together in a closely mated relationship, the combination with said holding means and said base means of a movable tensioning wing formed on said holding means for varying the degree of tightness between said holding means and said base means, said movable tensioning wing being movable toward and away from said base means.

7. The structure as recited by claim 6 wherein said tensioning wing is a deflectable wing formed on said holding means.

8. The structure as recited by claim 7 to include wedging means for deflecting said tensioning wing into tighter contact with said base means.

9. The structure as recited by claim 8 to include lever means for providing leverage to said wedging means.

10. The structure as recited by claim 7 wherein said deflectable wing is undercut to facilitate deflection.

11. In a telescope mount having holding means for holding a telescope, base means for attachment to a firearm, said holding means engaging said base means in a mated relationship, the combination with said holding means and said base means of tensioning means, said tensioning means comprising:

a deflectable wing, said wing being movably adjustable and mounted on said holding means, the under surface of said wing exerting tension against the top surface of said base means, for varying the degree of tightness between said holding means and said base means, said wing being movable toward or away from said base means.

* * * * *